US011111569B2

(12) United States Patent
Miyakoshi et al.

(10) Patent No.: US 11,111,569 B2
(45) Date of Patent: Sep. 7, 2021

(54) NON-HEAT TREATED STEEL BAR

(71) Applicant: Nippon Steel Corporation, Tokyo (JP)

(72) Inventors: Yusuke Miyakoshi, Tokyo (JP); Motoki Takasuga, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 150 days.

(21) Appl. No.: 16/486,563

(22) PCT Filed: Feb. 23, 2018

(86) PCT No.: PCT/JP2018/006606
§ 371 (c)(1),
(2) Date: Aug. 16, 2019

(87) PCT Pub. No.: WO2018/155604
PCT Pub. Date: Aug. 30, 2018

(65) Prior Publication Data

US 2020/0056271 A1 Feb. 20, 2020

(30) Foreign Application Priority Data

Feb. 24, 2017 (JP) ..... JP2017-033874

(51) Int. Cl.

| | |
|---|---|
| ***C22C 38/50*** | (2006.01) |
| ***C22C 38/46*** | (2006.01) |
| ***C22C 38/42*** | (2006.01) |
| ***C22C 38/22*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21C 7/10*** | (2006.01) |
| ***C21C 7/064*** | (2006.01) |
| ***C22C 38/60*** | (2006.01) |
| ***C22C 38/20*** | (2006.01) |
| ***C21C 7/04*** | (2006.01) |
| ***C22C 29/12*** | (2006.01) |
| ***C22C 38/12*** | (2006.01) |
| ***C22C 38/14*** | (2006.01) |
| ***C22C 38/24*** | (2006.01) |
| ***C22C 38/44*** | (2006.01) |
| ***C22C 38/40*** | (2006.01) |
| ***C22C 38/08*** | (2006.01) |
| ***C22C 38/28*** | (2006.01) |
| ***C22C 38/16*** | (2006.01) |
| ***C22C 38/18*** | (2006.01) |
| *C21C 7/06* | (2006.01) |

(Continued)

(52) U.S. Cl.

CPC ..... *C22C 38/50* (2013.01); *C21C 7/04* (2013.01); *C21C 7/064* (2013.01); *C21C 7/10* (2013.01); *C22C 29/12* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/20* (2013.01); *C22C 38/22* (2013.01); *C22C 38/24* (2013.01); *C22C 38/28* (2013.01); *C22C 38/40* (2013.01); *C22C 38/42* (2013.01); *C22C 38/44* (2013.01); *C22C 38/46* (2013.01); *C22C 38/60* (2013.01); *C21C 7/06* (2013.01); *C21D 8/005* (2013.01); *C21D 8/06* (2013.01); *C21D 8/065* (2013.01)

(58) Field of Classification Search

CPC ..... C22C 29/12; C22C 38/50; C22C 38/00; C22C 38/60; C22C 38/001; C22C 38/002; C22C 38/02; C22C 38/04; C22C 38/06; C22C 38/22; C22C 38/42; C22C 38/46; C22C 38/08; C22C 38/12; C22C 38/14; C22C 38/16; C22C 38/18; C22C 38/20; C22C 38/24; C22C 38/28; C22C 38/40; C22C 38/44; C21C 7/064; C21C 7/10; C21C 7/06; C21C 7/04; C21D 8/06; C21D 8/065; C21D 8/005

See application file for complete search history.

(56) References Cited

U.S. PATENT DOCUMENTS

2013/0087014 A1* 4/2013 Kim ..... C21D 9/30 74/595
2014/0178242 A1* 6/2014 Sano ..... C21D 9/0068 420/87

FOREIGN PATENT DOCUMENTS

JP 2004-277817 A 10/2004
JP 2006-336071 A 12/2006

(Continued)

OTHER PUBLICATIONS

English Abstract of JP-2004-277817.

(Continued)

*Primary Examiner* — Michael E. La Villa
(74) *Attorney, Agent, or Firm* — Banner & Witcoff, Ltd.

(57) ABSTRACT

A non-heat treated steel bar according to the present disclosure has a chemical composition consisting of, in mass percent, C: 0.39 to 0.55%, Si: 0.10 to 1.00%, Mn: 0.50 to 1.50%, P: 0.010 to 0.100%, S: 0.040 to 0.130%, Cr: 0.05 to 0.50%, V: 0.05 to 0.40%, Ti: 0.10% to 0.25%, Al: 0.003 to 0.100%, and N: 0.020% or less, with the balance being Fe and impurities, and satisfying Formula (1). A number density of $Al_2O_3$-based inclusions in each of which $Al_2O_3$ is contained at 70.0% or more in mass % and √AREA is not less than 3 μm is 0.05 to 1.00/mm$^2$.

$$0.60 \leq C+0.2Mn+0.25Cr+0.75V+0.81Mo \leq 1.00 \quad (1)$$

4 Claims, 2 Drawing Sheets

(51) Int. Cl.
*C21D 8/06* (2006.01)
*C21D 8/00* (2006.01)

(56) References Cited

FOREIGN PATENT DOCUMENTS

| | | | |
|---|---|---|---|
| JP | 2011-195862 | A | 10/2011 |
| WO | 2009107282 | A1 | 9/2009 |

OTHER PUBLICATIONS

English Abstract of JP-2006-336071.
English Abstract of JP-2011-195862.
English Abstract of WO-2009-107282A1.

* cited by examiner

NON-HEAT TREATED STEEL BAR

TECHNICAL FIELD

The present invention relates to a steel bar, more specifically to a steel bar used for a non-heat treated hot-forged product (hereafter, referred to as a non-heat treated steel bar).

BACKGROUND ART

A connecting rod used in an automobile engine and the like (hereafter, referred to also as a conrod) is an engine part for coupling a piston and a crankshaft, and converts reciprocating motion of the piston into rotating motion of the crank.

FIG. 1 is a front view of a conventional conrod. As illustrated in FIG. 1, the conventional conrod 1 includes a large end portion 100, a rod portion 200, and a small end portion 300. The large end portion 100 is located at one end of the rod portion 200, and the small end portion 300 is located at the other end of the rod portion 200. The large end portion 100 is coupled to a crank pin. The small end portion 300 is coupled to a piston.

The conventional conrod 1 includes two parts: a cap 2 and a rod 3. These parts are normally produced by hot forging. The cap 2 and one end portion of the rod 3 correspond to the large end portion 100. The rest other than the one end portion of the rod 3 corresponds to the rod portion 200 and the small end portion 300. The large end portion 100 and the small end portion 300 are formed by cutting. Therefore, the conrod 1 requires a high machinability.

The conrod 1 is subjected to loads from members around the conrod 1, when an engine runs. In recent years, there is a demand for reduction in size of the conrod 1 and improvement of an in-cylinder pressure of a cylinder for fuel saving. To this end, the conrod 1 is required to have an excellent yield strength that can bear explosive loads from a piston even with a thinner rod portion 200. In addition, the conrod is also required to have an excellent fatigue strength because the conrod is subjected to a compressive load and a tensile load repeatedly.

In recent years, from the view point of energy saving and cost reduction, the adoption of a non-heat treated conrod, for which thermal refining treatment (quenching and tempering) is omitted, has been started. Therefore, there is a demand for a non-heat treated steel that provides a sufficient yield strength, fatigue strength, and machinability without thermal refining treatment after hot forging.

By the way, as described above, for the conventional conrod 1, the cap 2 and the rod 3 are produced separately. Therefore, to position the cap 2 and the rod 3, a dowel pinning process is performed. In addition, a cutting working process is performed on mating surfaces of the cap 2 and the rod 3. Thus, a fracture splitting connecting rod, for which these processes can be omitted, is gaining popularity.

In a case of a fracture splitting connecting rod, the conrod is integrally molded, a jig is then inserted into a hole of a large end portion 100, a stress is applied to break off the large end portion, and the large end portion 100 is separated into two parts (corresponding to a cap 2 and a rod 3). Then, when the conrod is attached to a crankshaft, the separated two parts are joined. As long as the fracture surfaces of the large end portion 100 are brittle fracture surfaces, which are free from deformation, the fracture surfaces of the cap 2 and the rod 3 can be fit and connected by a bolt. In this case, therefore, the dowel pinning process and the cutting working process are omitted. The result is that a production cost is reduced.

Japanese Patent Application Publication No. 2004-277817 (Patent Literature 1), Japanese Patent Application Publication No. 2011-195862 (Patent Literature 2), International Application Publication No. WO2009/107282 (Patent Literature 3), and Japanese Patent Application Publication No. 2006-336071 (Patent Literature 4) propose steels having high fracture splittabilities.

A high-strength non-heat treated steel disclosed in Patent Literature 1 has a composition consisting of, in weight percent, C: 0.2 to 0.6%, Si: 0.1 to 2%, Mn: 0.1 to 1.5%, S: 0.03 to 0.2%, P: 0.02 to 0.15%, Cu: 0.03 to 1%, Ni: 0.03 to 1%, Cr: 0.05 to 1%, V: 0.02 to 0.4%, Ti: 0.01 to 0.8%, s-Al: 0.005 to 0.045%, and N: 0.008 to 0.035%, with the balance being unavoidable impurities and Fe, and includes a ferrite-pearlite structure. The maximum diameter of TiN inclusions in the steel is 5 μm or more, and the number of the TiN inclusions is not less than $5/mm^2$ in terms of number density. This high-strength non-heat treated steel has a high strength, a high machinability, a high fracture splittability. In addition, Patent Literature 1 describes that the non-heat treated steel can form preferable unevenness on its fracture surfaces when broken off.

A non-heat treated steel to be hot-forged disclosed in Patent Literature 2 contains, in mass percent, C: 0.35 to 0.55%, Si: 0.15 to 0.40%, Mn: 0.50 to 1.00%, P: 0.100% or less, S: 0.040 to 0.100%, Cr: 1.00% or less, V: 0.20 to 0.50%, Ca: 0.0005 to 0.0100%, and N: 0.0150% or less, with the balance being Fe and unavoidable impurities. In a chemical composition of the steel, $2Mn+5Mo+Cr \leq 3.1$ and $C+Si/5+Mn/10+10P+5V \geq 1.8$ are satisfied, and $Ceq=C+Si/7+Mn/5+Cr/9+V$ falls within a range of 0.90 to 1.10. The steel has a hardness of HV330 or more and a yield ratio of 0.73 or more. A structure of the steel is a ferrite-pearlite structure including 10% or less of bainite. Patent Literature 2 describes that this non-heat treated steel to be hot-forged can provide a hot-forged non-heat treated steel part that is allowed to have an excellent machinability and fracture splittability while allowed to have a high strength.

A non-heat treated steel to be hot-forged disclosed in Patent Literature 3 contains, in mass percent, C: more than 0.35% to 0.60%, Si: 0.50 to 2.50%, Mn: 0.20 to 2.00%, P: 0.010 to 0.150%, S: 0.040 to 0.150%, V: 0.10 to 0.50%, Zr: 0.0005 to 0.0050%, Ca: 0.0005 to 0.0050%, N: 0.0020 to 0.0200%, and Al: limited to less than 0.010%, with the balance substantially being Fe and unavoidable impurities. Patent Literature 3 describes that this non-heat treated steel to be hot-forged is excellent in fracture splittability and machinability.

A steel for conrod disclosed in Patent Literature 4 contains, in mass percent, C: 0.1 to 0.5%, Si: 0.1 to 2%, Mn: 0.5 to 2%, P: 0.15% or less (0% exclusive), S: 0.06 to 0.2%, N: 0.02% or less (0% exclusive), Ca: 0.0001 to 0.005%, and Al: 0.001 to 0.02%, with the balance being Fe and unavoidable impurities. A composition of oxide-based inclusions present in this steel for connecting rod is controlled within a predetermined range. Specifically, its fracture splittability becomes insufficient when the oxide-based inclusions mainly include $Al_2O_3$ or $SiO_2$. Hence, according to this literature, the intention is to prevent an imbalance from occurring in these three components, $Al_2O_3$, $SiO_2$, and CaO in the oxide-based inclusions. Patent Literature 4 describes that the fracture splittability can be thereby increased (see the paragraph [0009] of Patent Literature 4).

CITATION LIST

Patent Literature

Patent Literature 1: Japanese Patent Application Publication No. 2004-277817

Patent Literature 2: Japanese Patent Application Publication No. 2011-195862

Patent Literature 3: International Application Publication No. W02009/107282

Patent Literature 4: Japanese Patent Application Publication No. 2006-336071

SUMMARY OF INVENTION

Technical Problem

To produce the fracture splitting connecting rod, the integral molding of the conrod is performed normally by hot forging. In the present specification, a non-heat treated steel bar after hot forging is also referred to as a "hot-forged product". Here, in a case of producing fracture splitting connecting rods in mass production, bainite may be partly produced in hot-forged products due to variations in the temperature of a reheating furnace or processing-incurred heat. In this case, fracture splittabilities of the hot-forged products are decreased.

Specifically, bainite has a high toughness, and if bainite is present in a microstructure in a hot-forged product, a ductile fracture surface is likely to occur on a fracture surface after cracking. The occurrence of the ductile fracture surface means that the large end portion may be plastically deformed. This prevents the fracture surfaces from being snugly fit together, and an inner diameter D of the large end portion 100 of FIG. 1 deviates from a desired value. As a result, uneven contact occurs in a crank coupling portion (large end portion 100), which can cause vibration or noise during traveling of an automobile.

In Patent Literature 1 described above, when bainite is produced in the hot-forged product, a ductile fracture surface may occur on a fracture surface, which causes the inner diameter of a large end portion to be deformed, resulting in a decrease in fracture splittability.

In Patent Literature 2, bainite produced in the hot-forged product is allowed to some extent. However, in the case of the steel of Patent Literature 2, when a bainite ratio is more than 10%, a ductile fracture surface may occur on a fracture surface, resulting in a decrease in the fracture splittability.

In Patent Literature 3, it is assumed that the microstructure of the hot-forged product mainly contains ferrite and pearlite. Therefore, when bainite is produced in the hot-forged product, the fracture splittability may be decreased.

Patent Literature 4 has no mention about a fracture splittability in a case where bainite is produced in the hot-forged product. Therefore, when bainite is produced in the hot-forged product, its fracture splittability may be made low.

An objective of the present disclosure is to provide a non-heat treated steel bar having an excellent hot workability, having a high yield strength, a high fatigue strength, and an excellent machinability after hot forging, and having an excellent fracture splittability even when bainite is produced after the hot forging.

Solution to Problem

A non-heat treated steel bar according to the present disclosure has a chemical composition consisting of, in mass percent; C: 0.39 to 0.55%; Si: 0.10 to 1.00%; Mn: 0.50 to 1.50%; P: 0.010 to 0.100%; S: 0.040 to 0.130%; Cr: 0.05 to 0.50%; V: 0.05 to 0.40%; Ti: 0.10% to 0.25%; Al: 0.003 to 0.100%; N: 0.020% or less; Cu: 0 to 0.40%; Ni: 0 to less than 0.20%; Mo: 0 to 0.10%; Pb: 0 to 0.30%; Te: 0 to 0.3000%; Ca: 0 to 0.0100%; and Bi: 0 to 0.3000%, with the balance being Fe and impurities, and satisfying Formula (1). The non-heat treated steel bar according to the present disclosure contains a number density of $Al_2O_3$-based inclusions in each of which $Al_2O_3$ is contained at 70.0% or more in mass percent and $\sqrt{AREA}$ is not less than 3 μm is 0.05 to 1.00/mm$^2$.

$$0.60 \leq C+0.2Mn+0.25Cr+0.75V+0.81Mo \leq 1.00 \quad (1)$$

where, symbols of elements in Formula (1) are to be substituted by contents of corresponding elements (in mass percent).

Advantageous Effects of Invention

The non-heat treated steel bar according to the present disclosure has an excellent hot workability, has a high yield strength, a high fatigue strength, and an excellent machinability after hot forging, and has an excellent fracture splittability even when bainite is produced after the hot forging.

DESCRIPTION OF EMBODIMENTS

Figure 1:
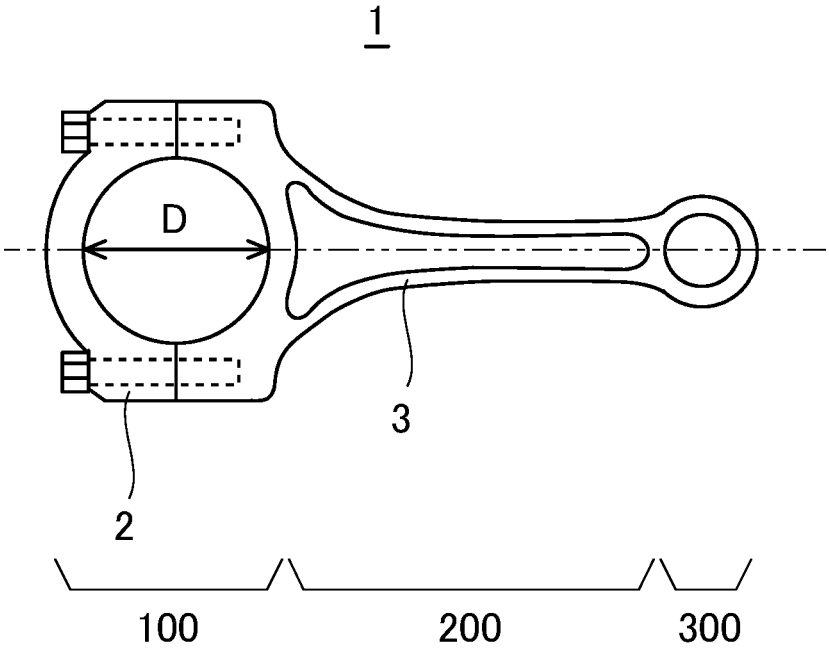
FIG. 1 is a front view of a conventional connecting rod.

An embodiment of the present invention will be described below in detail.

The present inventors conducted investigations and studies on a hot workability of a non-heat treated steel bar, and a yield strength, a fatigue strength, a machinability, and a fracture splittability of a non-heat treated steel bar after hot forging (hot-forged product). Consequently, the present inventors obtained the following findings.

(A) Strength and Machinability

The strength and the machinability are mutually contradictory mechanical properties to the machinability. However, if a chemical composition can be adjusted properly, the compatibility between these mechanical properties can be established.

Define fn1 as fn1=C+0.2Mn+0.25Cr+0.75V+0.81Mo. The above fn1 is an index of the strength and shows a positive correlation with the yield strength. In a non-heat treated steel bar that has a chemical composition consisting of, in mass percent, C: 0.39 to 0.55%, Si: 0.10 to 1.00%, Mn: 0.50 to 1.50%, P: 0.010 to 0.100%, S: 0.040 to 0.130%, Cr: 0.05 to 0.50%, V: 0.05 to 0.40%, Ti: 0.10% to 0.25%, Al: 0.003 to 0.100%, N: 0.020% or less, Cu: 0 to 0.40%, Ni: 0 to less than 0.20%, Mo: 0 to 0.10%, Pb: 0 to 0.30%, Te: 0 to 0.3000%, Ca: 0 to 0.0100%, and Bi: 0 to 0.3000%, with the balance being Fe and impurities, when fn1 is more than 1.00, the strength of the steel becomes excessively high which results in a decrease in the machinability of the steel, and when fn1 is less than 0.60, the yield strength of the steel becomes excessively low. When the non-heat treated steel bar having the above chemical composition has fn1 falling within a range of 0.60 to 1.00, an excellent yield strength and an excellent machinability are obtained even after hot forging.

(B) Fracture Splittability

In the present specification, the phrase "having a high fracture splittability" means that a fracture surface of a hot-forged product resists developing a ductile fracture surface. As described above, to increase the fracture splittability of the hot-forged product, a toughness of the hot-forged product is preferably made low. Here, a hot-forged product to be used as a fracture splitting connecting rod normally has an absorbed energy E (2 mmV) in the Charpy impact test defined in JIS Z 2242 (2005) of less than about 20 J/cm$^2$. In addition, the hot-forged product has a fracture toughness value $K_Q$ defined in ASTM E399-06 of about less than 40 MPa√m.

As described above, in a hot-forged product, bainite may be produced in its microstructure. Since bainite has a high toughness, a hot-forged product in which bainite is produced is likely to cause a ductile fracture surface on its fracture surface after cracking. That is, in a case where bainite is produced in its microstructure, a fracture splittability of a hot-forged product is decreased. Hence, the present inventors conducted investigations and studies on increasing the fracture splittability even in the case where bainite is produced in the microstructure. As a result, the present inventors have found that, among the oxide-based inclusions remaining in the non-heat treated steel bar that has the above chemical composition, the chemical composition satisfying Formula (1), $Al_2O_3$-based inclusions, which mainly contain $Al_2O_3$, particularly contribute to improvement of the fracture splittability of the hot-forged product. This regard will be described below in detail.

Al (aluminum) is added as a deoxidizer in deoxidation treatment in the refining step, where Al combines with oxygen in molten steel to form $Al_2O_3$. Typically, $Al_2O_3$ agglomerates and coalesces in the molten steel, and surfaces and is then removed. Meanwhile, a part of the $Al_2O_3$ remains in the steel, forming $Al_2O_3$-based inclusions. Here, in the present specification, the $Al_2O_3$-based inclusions refer to inclusions containing $Al_2O_3$ at 70.0% or more in mass percent.

The $Al_2O_3$-based inclusions remaining in the steel are not dissolved but remain even in a steel bar or a hot-forged product. That is, the $Al_2O_3$-based inclusions remaining in a hot-forged product can increase the fracture splittability of the hot-forged product. The present inventors consider that the reason for this is as follows.

The $Al_2O_3$-based inclusions in the steel have toughnesses that are extremely low as compared with that of a base metal of the steel. Therefore, the $Al_2O_3$-based inclusions suffer brittle fracture in the cracking. The $Al_2O_3$-based inclusions suffering brittle fracture serve as starting points of fracture, and sharp initial cracks develop in interfaces between the $Al_2O_3$-based inclusions suffering brittle fracture and matrices. In a sharp crack, a strong plastic constraint is imposed on its tip, which easily causes a brittle fracture in the steel. An initial crack propagates in a brittle manner into a crack and connects to an adjacent crack developing from another $Al_2O_3$-based inclusion, by which the brittle fracture advances, and as a result, a brittle fracture surface is formed. Therefore, even in a microstructure containing bainite having a high toughness, development of the above initial cracks caused by the $Al_2O_3$-based inclusions makes brittle cracks likely to advance. Therefore, a fracture surface becomes a brittle fracture surface, so that a ductile fracture surface is inhibited. As a result, an excellent fracture splittability is obtained.

In contrast, as deoxidizers other than Al, Si (silicon) and Ca (calcium) are widely used. Si and Ca form $SiO_2$ and CaO, respectively, in molten steel. When present in steel, $SiO_2$ tends to decrease a fatigue strength and hot workability of the steel. In addition, CaO has a toughness that is high as compared with that of $Al_2O_3$; therefore, CaO cannot increase fracture splittability of the steel better than $Al_2O_3$.

As seen from the above, to increase a fracture splittability of a steel after hot forging while keeping a hot workability of the steel, it is appropriate to use $Al_2O_3$-based inclusions from among oxide-based inclusions in the steel rather than $SiO_2$ or CaO. Base on the above idea, the present inventors conducted additional investigations and studies about a proper number density of the $Al_2O_3$-based inclusions. As a result, the present inventors have found that, in the non-heat treated steel bar having the above chemical composition and satisfying Formula (1), when a number density of $Al_2O_3$-based inclusions being 3 μm or more in terms of √AREA in the steel (hereinafter, also referred to as "coarse $Al_2O_3$-based inclusions") is 0.05 to 1.00/mm$^2$, an excellent fracture splittability is obtained while a hot workability, and a yield strength, a fatigue strength, and a machinability after hot forging are kept, even when bainite is produced to some extent after the hot forging.

A non-heat treated steel bar according to the present embodiment that is made based on the above findings has a chemical composition consisting of, in mass percent; C: 0.39 to 0.55%; Si: 0.10 to 1.00%; Mn: 0.50 to 1.50%; P: 0.010 to 0.100%; S: 0.040 to 0.130%; Cr: 0.05 to 0.50%; V: 0.05 to 0.40%; Ti: 0.10% to 0.25%; Al: 0.003 to 0.100%; N: 0.020% or less; Cu: 0 to 0.40%; Ni: 0 to less than 0.20%; Mo: 0 to 0.10%; Pb: 0 to 0.30%; Te: 0 to 0.3000%; Ca: 0 to 0.0100%; and Bi: 0 to 0.3000%, with the balance being Fe and impurities, and satisfying Formula (1). In the steel, a number density of $Al_2O_3$-based inclusions in each of which $Al_2O_3$ is contained at 70.0% or more in mass percent and √AREA is not less than 3 μis 0.05 to 1.00/mm$^2$.

$$0.60 \leq C+0.2Mn+0.25Cr+0.75V+0.81Mo \leq 1.00 \quad (1)$$

where, symbols of elements in Formula (1) are to be substituted by contents of corresponding elements (in mass percent).

The above chemical composition of the non-heat treated steel bar may contain one or more types of element selected from the group consisting of Cu: 0.01 to 0.40%, Ni: 0.01 to less than 0.20%, and Mo: 0.01 to 0.10%.

The above chemical composition of the non-heat treated steel bar may contain one or more types of element selected from the group consisting of Pb: 0.05 to 0.30%, Te: 0.0003 to 0.3000%, Ca: 0.0003 to 0.0100%, and Bi: 0.0003 to 0.3000%.

The non-heat treated steel bar according to the present embodiment will be described below in detail. The sign "%" following each element means mass percent unless otherwise noted.

[Chemical Composition]

The chemical composition of the non-heat treated steel bar according to the present embodiment contains the following elements.

C: 0.39 to 0.55%

Carbon (C) increases the yield strength and the fatigue strength of the steel. An excessively low content of C results in failure to provide this effect. In contrast, an excessively high content of C results in a decrease in machinability of the steel. Consequently, the content of C is 0.39 to 0.55%. A lower limit of the content of C is preferably 0.40%, more preferably 0.41%, still more preferably 0.42%. An upper limit of the content of C is preferably 0.54%, more preferably 0.53%, still more preferably 0.52%.

Si: 0.10 to 1.00%

Silicon (Si) is dissolved in steel, increasing the fatigue strength of the steel. An excessively low content of Si results in failure to provide this effect. In contrast, an excessively high content of Si makes the above effects saturated. An excessively high content of Si further results in a decrease in the hot workability of the steel, increasing a production cost of the steel bar. Consequently, the content of Si is 0.10 to 1.00%. A lower limit of the content of Si is preferably 0.11%, more preferably 0.12%, still more preferably 0.15%. An upper limit of the content of Si is preferably 0.99%, more preferably 0.95%, still more preferably 0.90%.

Mn: 0.50 to 1.50%

Manganese (Mn) deoxidizes steel. In addition, Mn increases the yield strength and the fatigue strength of the steel. An excessively low content of Mn results in failure to provide these effects. In contrast, an excessively high content of Mn results in a decrease in the hot workability of the steel. Consequently, the content of Mn is 0.50 to 1.50%. A lower limit of the content of Mn is preferably 0.51%, more preferably 0.55%, still more preferably 0.60%. An upper limit of the content of Mn is preferably 1.49%, more preferably 1.45%, still more preferably 1.40%.

P: 0.010 to 0.100%

Phosphorus (P) segregates in grain boundaries, embrittling steel. Therefore, when a fracture splitting connecting rod is broken off to be separated, fracture surfaces of the fracture splitting connecting rod becomes brittle. As a result, in the fracture splitting connecting rod after broken off to be separated, the large end inner diameter deformation amount becomes small. That is, a fracture splittability of the steel after hot forging is increased. An excessively low content of P results in failure to provide this effect. In contrast, an excessively high content of P results in a decrease in the hot workability of the steel. Consequently, the content of P is 0.010 to 0.100%. A lower limit of the content of P is preferably 0.011%, more preferably 0.015%, still more preferably 0.020%. An upper limit of the content of P is preferably 0.090%, more preferably 0.080%, still more preferably 0.070%.

S: 0.040 to 0.130%

Sulfur (S) combines with Mn and Ti to form their sulfides, increasing the machinability of the steel. An excessively low content of S results in failure to provide this effect. In contrast, an excessively high content of S results in a decrease in the hot workability of the steel. Consequently, the content of S is 0.040 to 0.130%. A lower limit of the content of S is preferably 0.041%, more preferably 0.045%, still more preferably 0.050%. An upper limit of the content of S is preferably 0.129%, more preferably 0.125%, still more preferably 0.120%.

Cr: 0.05 to 0.50%

Chromium (Cr) increases the yield strength and the fatigue strength of the steel. An excessively low content of Cr results in failure to provide this effect. Meanwhile, an excessively high content of Cr leads to the excessive hardness of a steel material, resulting in a decrease in machinability. An excessively high content of Cr further results in an increase in a production cost. Consequently, the content of Cr is 0.05 to 0.50%. A lower limit of the content of Cr is preferably 0.10%, more preferably 0.12%, still more preferably 0.15%. An upper limit of the content of Cr is preferably 0.49%, more preferably 0.45%, still more preferably 0.40%.

V: 0.05% to 0.40%

Vanadium (V) precipitates in a form of its carbide in ferrite during a cooling process after hot forging, increasing the yield strength and the fatigue strength of the steel. An excessively low content of V results in failure to provide this effect. In contrast, an excessively high content of V results in an extremely high production cost of the steel. An excessively high content of V further results in a decrease in machinability of the steel. Consequently, the content of V is 0.05 to 0.40%. A lower limit of the content of V is preferably 0.06%, more preferably 0.07%, still more preferably 0.10%. An upper limit of the content of V is preferably 0.39%, more preferably 0.35%, still more preferably 0.32%.

Ti: 0.10% to 0.25%

Ti (titanium) precipitates together with V in a form of its carbide during a cooling process and a heating process after hot forging, increasing a fatigue strength of the steel after the hot forging. In addition, in a solidification process of molten steel in continuous casting, Ti forms Ti sulfide and Ti carbo-sulfide, increasing a machinability of the steel. An excessively low content of Ti results in failure to provide these effects. In contrast, an excessively high content of Ti results in a decrease in the hot workability. Consequently, the content of Ti is 0.10 to 0.25%. A lower limit of the content of Ti is preferably more than 0.12%, more preferably 0.15%. An upper limit of the content of Ti is preferably 0.24%, more preferably 0.22%.

Al: 0.003 to 0.100%

Aluminum (Al) deoxidizes steel. In addition, Al causes coarse $Al_2O_3$-based inclusions to remain in the steel, increasing a fracture splittability of a hot-forged product. An excessively low content of Al results in failure to provide these effects. In contrast, an excessively high content of Al causes the coarse $Al_2O_3$-based inclusions to be produced excessively, resulting in a decrease in fatigue strength and hot workability of the steel. In addition, an excessively high content of Al results in an increase in production costs. Consequently, the content of Al is 0.003 to 0.100%. A lower limit of the content of Al is preferably 0.004%, more preferably 0.005%, still more preferably 0.006%, still more preferably 0.011%. An upper limit of the content of Al is preferably 0.080%, more preferably 0.060%, still more preferably 0.050%. In the non-heat treated steel bar according to the present embodiment, the content of Al means a total content of Al.

N: 0.020% or Less

Nitrogen (N) is unavoidably contained. That is, a content of N is more than 0%. N combines with Al to form AlN, inhibiting formation of $Al_2O_3$. As a result, a fracture splittability of the steel after hot forging is decreased. Accordingly, the content of N is 0.020% or less. An upper limit of the N content is preferably 0.015%, more preferably is 0.010%. The content of N is preferably made as low as possible.

The balance of the chemical composition of the non-heat treated steel bar according to the present embodiment is Fe and impurities. Here, the impurities mean elements that are mixed from ores and scraps used as raw material, a producing environment, or the like when the non-heat treated steel bar is produced in an industrial manner, and are allowed to be mixed within ranges in which the impurities have no adverse effect on the non-heat treated steel bar according to the present embodiment.

[Optional Element]

The non-heat treated steel bar according to the present embodiment may further contain, in lieu of a part of Fe, one or more types of element selected from the group consisting of Cu, Ni, and Mo. All of these elements increase the strength of the steel.

Cu: 0 to 0.40%

Copper (Cu) is an optional element and need not be contained. That is, a content of Cu may be 0%. When Cu is contained, Cu is dissolved in the steel, increasing a fatigue strength of the steel. Even a trace amount of Cu can provide the above effect to some extent. However, an excessively high content of Cu results in a high production cost of the steel. An excessively high content of Cu further results in a decrease in machinability of the steel. Consequently, the content of Cu is 0 to 0.40%. A lower limit of the content of Cu is preferably 0.01%, more preferably 0.05%, still more preferably 0.10%. An upper limit of the content of Cu is preferably 0.39%, more preferably 0.35%, still more preferably 0.30%.

Ni: 0 to less than 0.20%

Nickel (Ni) is an optional element and need not be contained. That is, a content of Ni may be 0%. When Ni is contained, Ni is dissolved in the steel, increasing a fatigue strength of the steel. Even a trace amount of Ni can provide the above effect to some extent. However, an excessively high content of Ni results in an increase in production costs of the steel. In addition, an excessively high content of Ni causes a rise in a toughness of the steel. As a result, a ductile fracture surface is developed on a fracture surface after fracture splitting, decreasing a fracture splittability of a hot-forged product. Consequently, the content of Ni is 0 to less than 0.20%. A lower limit of the content of Ni is preferably 0.01%, more preferably 0.02%, still more preferably 0.05%. An upper limit of the content of Ni is preferably 0.19%, more preferably 0.18%, still more preferably 0.15%.

Mo: 0 to 0.10%

Molybdenum (Mo) is an optional element and need not be contained. That is, a content of Mo may be 0%. When Mo is contained, Mo forms its carbide in the steel, increasing a yield strength and a fatigue strength of the steel. Even a trace amount of Mo can provide the above effect to some extent. However, an excessively high content of Mo leads to an increase in the hardness of the steel, resulting in a decrease in the machinability of the steel. An excessively high content of Mo further results in an increase in a production cost of the steel. Consequently, the content of Mo is 0 to 0.10%. A lower limit of the content of Mo is preferably 0.01%, more preferably 0.02%, still more preferably 0.05%. An upper limit of the content of Mo is preferably 0.09%, more preferably 0.08%, still more preferably 0.07%.

The non-heat treated steel bar according to the present embodiment may further contain, in lieu of a part of Fe, one or more types of element selected from the group consisting of Pb, Te, Ca, and Bi. All of these elements increase the machinability of the steel.

Pb: 0 to 0.30%

Lead (Pb) is an optional element and need not be contained. That is, a content of Pb may be 0%. When Pb is contained, Pb increases a machinability of the steel. Even a trace amount of Pb can provide the above effect to some extent. However, an excessively high content of Pb results in a decrease in the hot workability of the steel. Consequently, the content of Pb is 0 to 0.30%. A lower limit of the content of Pb is preferably 0.05%, more preferably 0.10%. An upper limit of the content of Pb is preferably 0.29%, more preferably 0.25%, still more preferably 0.20%.

Te: 0 to 0.3000%

Tellurium (Te) is an optional element and need not be contained. That is, a content of Te may be 0%. When Te is contained, Te increases a machinability of the steel. Even a trace amount of Te can provide the above effect to some extent. However, an excessively high content of Te results in a decrease in the hot workability of the steel. Consequently, the content of Te is 0 to 0.3000%. A lower limit of the content of Te is preferably 0.0003%, more preferably 0.0005%, still more preferably 0.0010%. An upper limit of the content of Te is preferably 0.2900%, more preferably 0.2500%, still more preferably 0.2000%.

Ca: 0 to 0.0100%

Calcium (Ca) is an optional element and thus need not be contained. That is, a content of Ca may be 0%. When Ca is contained, Ca increases a machinability of the steel. Even a trace amount of Ca can provide the above effect to some extent. However, an excessively high content of Ca results in a decrease in the hot workability of the steel. Consequently, the content of Ca is 0 to 0.0100%. A lower limit of the content of Ca is preferably 0.0003%, more preferably 0.0005%, still more preferably 0.0010%. An upper limit of the content of Ca is preferably 0.0090%, more preferably 0.0080%, still more preferably 0.0050%.

Bi: 0 to 0.3000%

Bismuth (Bi) is an optional element and need not be contained. That is, a content of Bi may be 0%. When Bi is contained, Bi increases a machinability of the steel. Even a trace amount of Bi can provide the above effect to some extent. However, an excessively high content of Bi results in a decrease in the hot workability of the steel. Consequently, the content of Bi is 0 to 0.3000%. A lower limit of the content of Bi is preferably 0.0003%, more preferably 0.0005%, still more preferably 0.0010%. An upper limit of the content of Bi is preferably 0.2900%, more preferably 0.2000%, still more preferably 0.1000%.

[Formula (1)]

The chemical composition of the non-heat treated steel bar according to the present embodiment further satisfies Formula (1):

$$0.60 \leq C+0.2Mn+0.25Cr+0.75V+0.81Mo \leq 1.00 \quad (1)$$

where, symbols of elements in Formula (1) are to be substituted by contents of corresponding elements (in mass percent).

The value fn1(=C+0.2Mn+0.25Cr+0.75V+0.81Mo) is an index of a strength of the steel. When fn1 is less than 0.60, the strength of the steel is excessively low. In this case, a fatigue strength of the steel after hot forging is decreased. In contrast, when fn1 is more than 1.00, the strength of the steel becomes excessively high. In this case, a machinability of the steel after hot forging is decreased. Consequently, fn1 is 0.60 to 1.00. A lower limit of fn1 is preferably 0.61, more preferably 0.63, still more preferably 0.65. An upper limit of fn1 is preferably 0.99, more preferably 0.98, still more preferably 0.95.

[Microstructure]

The microstructure of the non-heat treated steel bar according to the present embodiment mainly contains ferrite and pearlite. Specifically, in the non-heat treated steel bar having the above chemical composition, a total area fraction of ferrite and pearlite in the microstructure is preferably not less than 65%. When the total area fraction of the ferrite and the pearlite is not 100%, the balance of a matrix structure is bainite. A lower limit of the total area fraction of the ferrite and the pearlite is preferably 70%, more preferably 75%, still more preferably 80% or more, most preferably 100%. An upper limit of the area fraction of the bainite is preferably 30%, more preferably 25%, still more preferably 20%, most preferably 0%.

Note that the area fraction of the bainite in the microstructure can be measured by the following method. Ten samples are taken from arbitrary R/2 portions of the non-heat treated steel bar (center portions on line segments (radius) connecting the central axis of the steel bar and the outer peripheral surface of the steel bar). In each of the taken samples, a surface perpendicular to the central axis of the non-heat treated steel bar is determined as an observation surface. The observation surface is polished and thereafter etched with 3% nitric acid and alcohol (Nital etching reagent). The etched observation surface is observed under an optical microscope with 200× magnification, and photographic images of arbitrary five visual fields on the etched observation surface are created.

In each of the visual fields, phases containing ferrite, pearlite, bainite, and the like have their own different contrasts. Therefore, the phases are identified based on the respective contrasts. Of the identified phases, the area ($\mu m^2$) of the bainite is determined in each visual field. A ratio of the areas of bainite in all of the visual fields to the total area of all of the visual fields (five visual fields×10) is determined. The determined ratio is defined as the area fraction (%) of bainite.

[Number Density of Coarse $Al_2O_3$-Based Inclusions]

In the non-heat treated steel bar according to the present embodiment, a number density of $Al_2O_3$-based inclusions in each of which √AREA is not less than 3 μm (i.e., coarse $Al_2O_3$-based inclusions) is 0.05 to 1.00/mm$^2$. As described above, the $Al_2O_3$-based inclusions refer to inclusions containing $Al_2O_3$ at 70.0% or more in mass percent. That is, the $Al_2O_3$-based inclusions each have a content of $Al_2O_3$ (mass %) in the inclusions of 70.0% or more.

The non-heat treated steel bar according to the present embodiment is subjected to the hot forging to produce a fracture splitting connecting rod. In a case in which the unevenness in heating temperature in operation causes the temperature of the steel material in the hot forging to be 1300° C. or higher, bainite may be produced in the microstructure of a hot-forged product (the fracture splitting connecting rod), together with ferrite and pearlite. In this case, with the above chemical composition, the area fraction of the bainite to be produced is, for example, 5 to 30%.

Bainite has a high toughness as compared with ferrite and pearlite. For that reason, when the large end portion of a fracture splitting connecting rod is broken off to produce two parts (a cap and a rod), broken portions suffer plastic deformation, which brings about ductile fracture surfaces on broken surfaces. That is, the fracture splittability decreases.

When the number density of the coarse $Al_2O_3$-based inclusions is less than 0.05/mm$^2$, a sufficient fracture splittability cannot be obtained. In contrast, when the number density of the coarse $Al_2O_3$-based inclusions is more than 1.00/mm$^2$, an excellent fracture splittability can be obtained, whereas the fatigue strength and the hot workability are decreased. When the number density of the coarse $Al_2O_3$-based inclusions is 0.05 to 1.00/mm$^2$, an excellent fracture splittability can be obtained after hot forging while the fatigue strength and the hot workability are kept, even when bainite to be produced through hot forging.

A lower limit of the number density of the coarse $Al_2O_3$-based inclusions to further increase the fracture splittability is preferably 0.06/mm$^2$, more preferably 0.07/mm$^2$. An upper limit of the number density of the coarse $Al_2O_3$-based inclusions to further increase the fatigue strength and the hot workability is preferably 0.80/mm$^2$, more preferably 0.60/mm$^2$.

The number density of the coarse $Al_2O_3$-based inclusions can be measured by the following method. A sample is taken from an R/2 portion of the steel bar. From a surface of the sample corresponding to a cross section including an axis direction of a steel bar (longitudinal cross-section), 30 specimens each having a measurement area that is 4 mm long×2.5 mm wide are taken. Not being etched, observation surfaces of the 30 specimens are observed under an optical microscope with 200× magnification as it is, and photographic images are created. A total of the measurement areas is 300 mm$^2$.

On the observation surface (4 mm×2.5 mm) of each of the specimen, inclusions are identified based on their respective contrasts. From among the identified inclusions, oxide-based inclusions are identified based on their shapes and contrasts. On the identified oxide-based inclusions, contents of elements (mass %) in each of the oxide-based inclusions are measured using an electron probe micro analyzer (EPMA). From each of the analyzed contents of elements, a mass percent of $Al_2O_3$ in each of the oxide-based inclusions is calculated. Note that, in a case of performing the element analysis using the EPMA on all inclusions on the observation surface rather than identifying oxide-based inclusions based on their shapes and contrasts, inclusions each containing one or more types of Al, Ca, Si, and Mg, and oxygen (O) may be identified as oxide-based inclusions.

Within ranges of the chemical composition of the non-heat treated steel bar according to the present embodiment, most of oxides in the oxide-based inclusions are $Al_2O_3$, CaO, $SiO_2$, and MgO, and the rest of the oxides can be ignored. Hence, in the present embodiment, a content of $Al_2O_3$ in the inclusions (mass %) is defined as follows.

In each of the oxide-based inclusions, arbitrary three points are specified. At the specified points, contents of Al, Ca, Si, and Mg (mass %) are measured using an electron beam having a beam diameter of 1 μm. The measured contents of the elements are converted into contents of corresponding oxides, which are defined as calculated values of the oxides. More specifically, by multiplying the content of Al (mass %) measured using the EPMA by an atomic weight ratio of $Al_2O_3$ to Al(=molecular weight of $Al_2O_3$/(atomic weight of Al×2)), the calculated value of $Al_2O_3$ (mass %) at the specified point is determined.

Also for CaO, $SiO_2$, and MgO, the calculated values of CaO, $SiO_2$, and MgO (mass %) are determined as with $Al_2O_3$. A ratio of the calculated value of $Al_2O_3$ to a total of the determined calculated values of the oxides is determined, which is defined as a content of $Al_2O_3$ (mass %) at the specified arbitrary point. An arithmetic average of contents of $Al_2O_3$ (mass %) at the three specified points is defined as a "content of $Al_2O_3$ in inclusions (mass %)".

Inclusions in each of which a content of $Al_2O_3$ (mass %), specified by the above method, is 70.0% or more are identified as $Al_2O_3$-based inclusions. For each of the identified $Al_2O_3$-based inclusions, √AREA is calculated using an image analysis apparatus. Specifically, a length L (μm) and a width W (μm) of each of the identified $Al_2O_3$-based inclusions are determined. Assuming that each of the $Al_2O_3$-based inclusions is a rectangle, an area(=L×W ($\mu m^2$)) is determined. A square root of the area is determined, which is defined as √AREA (μm) of each of the $Al_2O_3$-based inclusions.

After determining √AREA of each of the $Al_2O_3$-based inclusions, coarse $Al_2O_3$-based inclusions in each of which √AREA is not less than 3 μm are identified. A number of the identified coarse $Al_2O_3$-based inclusions is determined, and a value obtained by dividing the number by the total of the measurement areas (300 $mm^2$) is defined as a number density of coarse $Al_2O_3$-based inclusions (/$mm^2$).

[Producing Method]

Description will be made about an example of a producing method for the above non-heat treated steel bar. The present producing method containing a refining step, a casting step, and a hot working step.

[Refining Step]

A molten steel satisfying the above chemical composition and Formula (1) is produced by a known method. Specifically, decarburization treatment, dephosphorization treatment, and desilication treatment are performed in a converter by a well-known method. Immediately after tapping of the molten steel, desulfurization treatment is performed by adding an aluminum deoxidizer to a ladle. As the ladle, a ladle exclusively for aluminum deoxidation is preferably used to prevent $SiO_2$ or CaO from being mixed in. In addition, the aluminum deoxidizer is preferably a metal Al or an Al alloy having a content of Al of 80% or more in mass percent.

After the desulfurization treatment, vacuum degassing treatment is performed. Here, by checking components of the molten steel during production and by adding the aluminum deoxidizer described above during the vacuum degassing treatment, a content of Al in the molten steel is adjusted. It is preferable that the aluminum deoxidizer added during the vacuum degassing treatment is 50 to 70% of a total added aluminum deoxidizer in mass percent.

To suppress production of $SiO_2$, Si is added after the steel is deoxidized sufficiently by the aluminum deoxidizer. The addition of Si is performed, for example, after a lapse of not more than 10 minutes from adding additional aluminum deoxidizer. In addition, to cause $Al_2O_3$ to agglomerate within a proper range, a time during which a temperature of the molten steel is 1600° C. or more is preferably 15 minutes to 60 minutes from adding the deoxidizer after tapping of the molten steel to starting casting. Through the above refining step, the molten steel satisfying the above chemical composition, Formula (1) and the definition of inclusions required of the non-heat treated steel bar according to the present embodiment is obtained.

[Casting Step]

Using the above molten steel, a cast piece (slab or bloom) or an ingot is produced by a well-known method. Examples of the method for casting contain a continuous casting process and an ingot-making process.

[Hot Working Step]

In the hot working step, the cast piece or the ingot produced in the above casting step is subjected to hot working to produce a steel bar. The hot working process is performed by a well-known method. The hot working step contains, for example, a rough rolling step and a finish rolling step. The rough rolling step is, for example, blooming. The finish rolling process is, for example, rolling using a continuous mill. In the continuous mill, horizontal stands and vertical stands are arranged alternately in a row, the horizontal stands each including a pair of horizontal rolls, the vertical stands each including a pair of vertical rolls. A heating temperature in the rough rolling process is, for example, 1000 to 1300° C., and a heating temperature in the finish rolling step is, for example, 1000 to 1300° C. Within these heating temperatures, forms of the $Al_2O_3$-based inclusions do not experience particular transformation.

Through the above producing process, the above non-heat treated steel bar is produced.

[Producing Method for Hot-Forged Product]

As an example of a producing method for a hot-forged product using the above non-heat treated steel bar, a producing method for a fracture splitting connecting rod will be described.

First, a steel material is heated in a high-frequency induction heating furnace. In this case, the temperature for the heating is preferably 1000 to 1300° C., and the duration of the heating is preferably 10 to 15 minutes. Since the temperature for heating is low, the forms of $Al_2O_3$-based inclusions in the steel bar do not change in particular. The heated steel bar is subjected to hot forging to produce the fracture splitting connecting rod. The reduction rate for the hot forging is preferably not less than 0.22. Here, the reduction rate is determined to be the maximum value of a logarithmic strain occurring in the forging step in portions other than burrs.

[Microstructure of Hot-Forged Product]

The microstructure of the produced hot-forged product (fracture splitting connecting rod) mainly contains ferrite and pearlite. In the microstructure, the total area fraction of the ferrite and pearlite is preferably 100%. However, if the temperature for heating the steel bar in the hot forging is more than 1300° C., the microstructure of the produced fracture splitting connecting rod may contain bainite.

In the microstructure of the fracture splitting connecting rod produced by the hot forging from the above non-heat treated steel bar, the total area fraction of the ferrite and pearlite is preferably not less than 65%. When the total area fraction of the ferrite and the pearlite is not 100%, the balance of a matrix structure is bainite. A lower limit of the total area fraction of the ferrite and the pearlite is preferably 70%, more preferably 75%, still more preferably 80% or more, most preferably 100%. An upper limit of the area fraction of the bainite is preferably 30%, more preferably 25%, still more preferably 20%, most preferably 0%. An example of the bainite area fraction is 5 to 30%.

In a case in which the bainite is contained in the microstructure, when the large end portion is broken off and divided into two parts (a cap and a rod), broken portions are prone to suffering plastic deformation and a part of the broken surface becomes ductile fracture surface, which is prone to resulting in a decrease in the fracture splittability. However, the non-heat treated steel bar according to the present embodiment has the above chemical composition, the chemical composition satisfies Formula (1), and in addition, of $Al_2O_3$-based inclusions containing $Al_2O_3$ at 70.0% or more in mass percent, the number density of $Al_2O_3$-based inclusions in each of which √AREA is 3 μm or more is 0.05 to 1.00/$mm^2$. Therefore, the broken surfaces likely become brittle fracture surfaces, which can maintain an excellent fracture splittability.

The area fraction of the bainite in the microstructure in the hot-forged product can be measured by the following method. Ten samples are taken from arbitrary portions of the hot-forged product. In each of the taken samples, phases in a microstructure are specified by the same method as that for the observation of the microstructure of the non-heat treated steel bar, and the area fraction of bainite is determined.

The above description is made about the producing method for the fracture splitting connecting rod as an example of the producing method of a forged product. However, the application of the non-heat treated steel bar according to the present embodiment is not limited to fracture splitting connecting rods. The non-heat treated steel bar according to the present embodiment is widely applicable to a forged product usage.

The producing method for the non-heat treated steel bar is not limited to the above producing method as long as the number density of $Al_2O_3$-based inclusions in each of which √AREA in steel is 3 μm or more is 0.05 to 1.00/mm$^2$. That is, the non-heat treated steel bar may be produced by another producing method.

EXAMPLES

Molten steels having chemical compositions shown in Table 1 and Table 2 were produced.

TABLE 1

| Test | Chemical Composition (in mass percent, balance being Fe and impurities) | | | | | | | | | | | |
|---|---|---|---|---|---|---|---|---|---|---|---|---|
| Number | C | Si | Mn | P | S | Cr | V | Ti | Al | N | Others | fn1 |
| 1 | 0.55 | 0.48 | 0.70 | 0.032 | 0.056 | 0.21 | 0.13 | 0.17 | 0.036 | 0.012 | — | 0.84 |
| 2 | 0.39 | 0.76 | 0.61 | 0.038 | 0.095 | 0.39 | 0.18 | 0.17 | 0.030 | 0.015 | — | 0.74 |
| 3 | 0.42 | 1.00 | 0.79 | 0.058 | 0.110 | 0.39 | 0.22 | 0.22 | 0.032 | 0.010 | — | 0.84 |
| 4 | 0.49 | 0.10 | 0.99 | 0.028 | 0.064 | 0.26 | 0.18 | 0.19 | 0.036 | 0.002 | — | 0.89 |
| 5 | 0.47 | 0.27 | 1.50 | 0.051 | 0.051 | 0.20 | 0.12 | 0.19 | 0.038 | 0.006 | — | 0.91 |
| 6 | 0.46 | 0.40 | 0.50 | 0.063 | 0.106 | 0.38 | 0.17 | 0.15 | 0.039 | 0.014 | — | 0.78 |
| 7 | 0.43 | 0.17 | 1.07 | 0.100 | 0.100 | 0.27 | 0.27 | 0.16 | 0.037 | 0.001 | — | 0.91 |
| 8 | 0.50 | 0.73 | 0.72 | 0.090 | 0.087 | 0.38 | 0.18 | 0.21 | 0.029 | 0.008 | — | 0.87 |
| 9 | 0.44 | 0.75 | 1.00 | 0.011 | 0.060 | 0.23 | 0.11 | 0.19 | 0.035 | 0.013 | — | 0.78 |
| 10 | 0.47 | 0.68 | 0.70 | 0.010 | 0.069 | 0.36 | 0.13 | 0.19 | 0.028 | 0.015 | — | 0.80 |
| 11 | 0.45 | 0.50 | 0.80 | 0.025 | 0.130 | 0.29 | 0.27 | 0.20 | 0.027 | 0.015 | — | 0.89 |
| 12 | 0.43 | 0.70 | 1.16 | 0.060 | 0.040 | 0.17 | 0.19 | 0.19 | 0.031 | 0.001 | — | 0.85 |
| 13 | 0.44 | 0.35 | 0.93 | 0.063 | 0.084 | 0.50 | 0.18 | 0.18 | 0.026 | 0.006 | — | 0.89 |
| 14 | 0.45 | 0.84 | 1.15 | 0.055 | 0.115 | 0.05 | 0.11 | 0.18 | 0.036 | 0.013 | — | 0.78 |
| 15 | 0.44 | 0.45 | 0.70 | 0.041 | 0.083 | 0.25 | 0.40 | 0.18 | 0.034 | 0.006 | — | 0.94 |
| 16 | 0.43 | 0.27 | 0.62 | 0.057 | 0.108 | 0.20 | 0.39 | 0.20 | 0.033 | 0.011 | — | 0.90 |
| 17 | 0.51 | 0.89 | 0.71 | 0.060 | 0.103 | 0.38 | 0.06 | 0.16 | 0.026 | 0.015 | — | 0.79 |
| 18 | 0.45 | 0.90 | 1.33 | 0.050 | 0.059 | 0.23 | 0.05 | 0.21 | 0.038 | 0.003 | — | 0.81 |
| 19 | 0.45 | 0.70 | 0.88 | 0.050 | 0.079 | 0.30 | 0.20 | 0.25 | 0.037 | 0.014 | — | 0.85 |
| 20 | 0.44 | 0.31 | 1.28 | 0.028 | 0.085 | 0.22 | 0.20 | 0.24 | 0.027 | 0.005 | — | 0.90 |
| 21 | 0.48 | 0.26 | 1.29 | 0.063 | 0.109 | 0.17 | 0.15 | 0.10 | 0.029 | 0.012 | — | 0.89 |
| 22 | 0.47 | 0.17 | 0.92 | 0.040 | 0.062 | 0.23 | 0.11 | 0.15 | 0.100 | 0.010 | — | 0.79 |
| 23 | 0.45 | 0.53 | 0.55 | 0.052 | 0.062 | 0.21 | 0.22 | 0.19 | 0.080 | 0.004 | — | 0.78 |
| 24 | 0.54 | 0.16 | 1.00 | 0.060 | 0.100 | 0.23 | 0.23 | 0.21 | 0.004 | 0.010 | — | 0.97 |
| 25 | 0.48 | 0.56 | 0.83 | 0.063 | 0.119 | 0.20 | 0.28 | 0.17 | 0.003 | 0.007 | — | 0.91 |
| 26 | 0.45 | 0.56 | 1.36 | 0.030 | 0.103 | 0.21 | 0.23 | 0.16 | 0.035 | 0.020 | — | 0.95 |
| 27 | 0.54 | 0.16 | 1.30 | 0.020 | 0.080 | 0.18 | 0.20 | 0.21 | 0.033 | 0.008 | — | 1.00 |
| 28 | 0.54 | 0.16 | 1.25 | 0.020 | 0.080 | 0.19 | 0.20 | 0.21 | 0.035 | 0.006 | — | 0.99 |
| 29 | 0.41 | 0.11 | 0.55 | 0.039 | 0.100 | 0.17 | 0.06 | 0.16 | 0.038 | 0.004 | — | 0.61 |
| 30 | 0.41 | 0.11 | 0.55 | 0.036 | 0.100 | 0.15 | 0.06 | 0.22 | 0.038 | 0.010 | — | 0.60 |

TABLE 2

| Test | Chemical Composition (in mass percent, balance being Fe and impurities) | | | | | | | | | | | |
|---|---|---|---|---|---|---|---|---|---|---|---|---|
| Number | C | Si | Mn | P | S | Cr | V | Ti | Al | N | Others | fn1 |
| 31 | 0.45 | 0.75 | 0.61 | 0.024 | 0.101 | 0.40 | 0.13 | 0.21 | 0.030 | 0.012 | — | 0.77 |
| 32 | 0.44 | 0.16 | 1.33 | 0.025 | 0.057 | 0.30 | 0.19 | 0.22 | 0.033 | 0.001 | — | 0.92 |
| 33 | 0.46 | 0.79 | 1.23 | 0.039 | 0.100 | 0.20 | 0.19 | 0.16 | 0.033 | 0.006 | — | 0.90 |
| 34 | 0.46 | 0.16 | 1.25 | 0.020 | 0.080 | 0.18 | 0.21 | 0.22 | 0.035 | 0.008 | — | 0.91 |
| 35 | 0.49 | 0.43 | 1.09 | 0.036 | 0.116 | 0.39 | 0.16 | 0.22 | 0.038 | 0.010 | — | 0.93 |
| 36 | 0.47 | 0.50 | 0.64 | 0.052 | 0.098 | 0.22 | 0.13 | 0.15 | 0.038 | 0.008 | — | 0.75 |
| 37 | 0.45 | 0.15 | 1.16 | 0.029 | 0.099 | 0.28 | 0.16 | 0.16 | 0.029 | 0.009 | Cu: 0.39 | 0.87 |
| 38 | 0.49 | 0.77 | 0.75 | 0.027 | 0.086 | 0.36 | 0.20 | 0.22 | 0.023 | 0.003 | Ni: 0.19 | 0.88 |
| 39 | 0.48 | 0.22 | 0.79 | 0.067 | 0.087 | 0.40 | 0.16 | 0.22 | 0.027 | 0.007 | Mo: 0.10 | 0.94 |
| 40 | 0.47 | 0.52 | 1.10 | 0.049 | 0.052 | 0.23 | 0.11 | 0.16 | 0.028 | 0.009 | Pb: 0.28 | 0.83 |
| 41 | 0.48 | 0.64 | 0.92 | 0.038 | 0.077 | 0.31 | 0.19 | 0.22 | 0.023 | 0.011 | Te: 0.2940 | 0.88 |
| 42 | 0.48 | 0.89 | 1.10 | 0.025 | 0.095 | 0.32 | 0.21 | 0.19 | 0.028 | 0.008 | Ca: 0.0098 | 0.94 |
| 43 | 0.49 | 0.36 | 0.80 | 0.028 | 0.067 | 0.23 | 0.10 | 0.18 | 0.028 | 0.001 | Bi: 0.2981 | 0.78 |
| 44 | 0.39 | 0.26 | 1.29 | 0.063 | 0.110 | 0.17 | 0.15 | 0.15 | 0.036 | 0.012 | — | 0.80 |
| 45 | 0.43 | 0.79 | 0.77 | 0.049 | 0.059 | 0.20 | 0.41 | 0.17 | 0.035 | 0.015 | — | 0.94 |
| 46 | 0.49 | 0.40 | 0.88 | 0.033 | 0.064 | 0.30 | 0.04 | 0.15 | 0.032 | 0.016 | — | 0.77 |
| 47 | 0.45 | 0.53 | 0.84 | 0.045 | 0.110 | 0.38 | 0.11 | 0.26 | 0.022 | 0.014 | — | 0.80 |
| 48 | 0.42 | 0.86 | 1.38 | 0.034 | 0.084 | 0.18 | 0.26 | 0.09 | 0.033 | 0.015 | — | 0.94 |
| 49 | 0.41 | 0.76 | 0.79 | 0.060 | 0.110 | 0.21 | 0.28 | 0.15 | 0.110 | 0.005 | — | 0.83 |
| 50 | 0.47 | 0.36 | 0.79 | 0.020 | 0.100 | 0.22 | 0.11 | 0.18 | 0.002 | 0.006 | — | 0.77 |

TABLE 2-continued

| Test Number | Chemical Composition (in mass percent, balance being Fe and impurities) | | | | | | | | | | | fn1 |
|---|---|---|---|---|---|---|---|---|---|---|---|---|
| | C | Si | Mn | P | S | Cr | V | Ti | Al | N | Others | |
| 51 | 0.53 | 0.16 | 1.38 | 0.052 | 0.080 | 0.18 | 0.21 | 0.22 | 0.035 | 0.008 | — | 1.01 |
| 52 | 0.40 | 0.11 | 0.55 | 0.020 | 0.100 | 0.14 | 0.06 | 0.22 | 0.035 | 0.008 | — | 0.59 |
| 53 | 0.46 | 0.40 | 1.25 | 0.038 | 0.109 | 0.36 | 0.17 | 0.16 | 0.038 | 0.012 | — | 0.93 |
| 54 | 0.41 | 0.16 | 1.20 | 0.063 | 0.110 | 0.40 | 0.27 | 0.21 | 0.028 | 0.001 | — | 0.95 |
| 55 | 0.54 | 0.27 | 0.64 | 0.052 | 0.116 | 0.14 | 0.13 | 0.19 | 0.032 | 0.006 | — | 0.80 |
| 56 | 0.47 | 0.79 | 1.09 | 0.049 | 0.098 | 0.38 | 0.18 | 0.17 | 0.035 | 0.012 | — | 0.92 |
| 57 | 0.45 | 0.45 | 1.25 | 0.060 | 0.110 | 0.23 | 0.16 | 0.15 | 0.035 | 0.015 | — | 0.88 |
| 58 | 0.47 | 0.16 | 0.55 | 0.060 | 0.084 | 0.36 | 0.19 | 0.16 | 0.038 | 0.008 | — | 0.81 |
| 59 | 0.47 | 0.89 | 1.33 | 0.028 | 0.100 | 0.21 | 0.20 | 0.21 | 0.031 | 0.006 | — | 0.94 |
| 60 | 0.38 | 0.61 | 0.13 | 0.050 | 0.098 | 0.10 | 0.39 | 0.15 | 0.007 | 0.032 | Cu: 0.20, Ni: 0.15 | 0.72 |
| 61 | 0.34 | 0.25 | 1.00 | 0.060 | 0.120 | 0.10 | 0.26 | — | 0.002 | 0.004 | Ca: 0.0008 | 0.76 |

Referring to Table 1 and Table 2, the chemical compositions of test numbers 1 to 44 and 53 to 59 were appropriate and satisfied Formula (1). Meanwhile, as to test numbers 45 to 52, 60 and 61, the chemical composition was inappropriate, or Formula (1) was not satisfied. Note that the chemical composition of Test Number 60 met the chemical composition of the steel described in Patent Literature 1, and the chemical composition of Test Number 61 met the chemical composition of the steel described in Patent Literature 4.

For each test number, a molten steel was subjected to first refining in a 70 ton converter and tapped into a ladle. For the molten steels of the test numbers, whether the ladle exclusively for aluminum deoxidation was used or not are shown in Table 3 and Table 4. Specifically, in the column "LADLE" in Table 3 and Table 4, "A" indicates that the ladle exclusively for aluminum deoxidation was used. In the column "LADLE" in Table 3 and Table 4, "B" indicates that the ladle exclusively for aluminum deoxidation was not used.

TABLE 3

| Test Number | fn1 | Number Density of Coarse $Al_2O_3$-Based Inclusions (/mm$^2$) | Ladle | Aluminum Deoxidizer | Proportion of Added Deoxidizer | Timing for Adding Si | Time of Holding Molten Steel | Bainite Area Fraction (%) | Hot Workability | Yield Strength | Fatigue Strength | Machinability | Fracture Splittability |
|---|---|---|---|---|---|---|---|---|---|---|---|---|---|
| 1 | 0.84 | 0.80 | A | A | A | A | A | 10 | A | A | A | C | A |
| 2 | 0.74 | 0.16 | A | A | A | A | A | 8 | A | A | C | A | A |
| 3 | 0.84 | 0.36 | A | A | A | A | A | 23 | C | A | A | A | A |
| 4 | 0.89 | 0.92 | A | A | A | A | A | 12 | A | A | C | A | A |
| 5 | 0.91 | 0.09 | A | A | A | A | A | 27 | C | A | A | A | A |
| 6 | 0.78 | 0.10 | A | A | A | A | A | 9 | A | A | C | A | A |
| 7 | 0.91 | 0.11 | A | A | A | A | A | 21 | C | A | A | A | A |
| 8 | 0.87 | 0.62 | A | A | A | A | A | 20 | B | A | A | A | A |
| 9 | 0.78 | 0.51 | A | A | A | A | A | 19 | A | A | A | A | B |
| 10 | 0.80 | 0.08 | A | A | A | A | A | 21 | A | A | A | A | C |
| 11 | 0.89 | 0.06 | A | A | A | A | A | 18 | C | A | A | A | A |
| 12 | 0.85 | 0.88 | A | A | A | A | A | 28 | A | A | A | C | A |
| 13 | 0.89 | 0.72 | A | A | A | A | A | 26 | A | A | A | C | A |
| 14 | 0.78 | 0.42 | A | A | A | A | A | 21 | A | A | C | A | A |
| 15 | 0.94 | 0.55 | A | A | A | A | A | 6 | A | A | A | C | A |
| 16 | 0.90 | 0.67 | A | A | A | A | A | 10 | A | A | A | B | A |
| 17 | 0.79 | 0.85 | A | A | A | A | A | 25 | A | A | B | A | A |
| 18 | 0.81 | 0.22 | A | A | A | A | A | 30 | A | A | C | A | A |
| 19 | 0.85 | 0.12 | A | A | A | A | A | 26 | C | A | A | A | A |
| 20 | 0.90 | 0.21 | A | A | A | A | A | 28 | B | A | A | A | A |
| 21 | 0.89 | 0.35 | A | A | A | A | A | 29 | A | A | C | A | A |
| 22 | 0.79 | 0.78 | A | A | A | A | A | 27 | C | A | A | A | A |
| 23 | 0.78 | 0.68 | A | A | A | A | A | 10 | B | A | A | A | A |
| 24 | 0.97 | 0.11 | A | A | A | A | A | 25 | A | A | A | A | B |
| 25 | 0.91 | 0.09 | A | A | A | A | A | 16 | A | A | A | A | C |
| 26 | 0.95 | 0.92 | A | A | A | A | A | 25 | A | A | A | A | C |
| 27 | 1.00 | 0.58 | A | A | A | A | A | 25 | A | A | A | C | A |
| 28 | 0.99 | 0.63 | A | A | A | A | A | 24 | A | A | A | B | A |
| 29 | 0.61 | 0.74 | A | A | A | A | A | 7 | A | B | A | A | A |
| 30 | 0.60 | 0.07 | A | A | A | A | A | 6 | A | C | A | A | A |

TABLE 4

| Test Number | fn1 | Number Density of Coarse $Al_2O_3$-Based Inclusions (/mm$^2$) | Ladle | Aluminum Deoxidizer | Proportion of Added Deoxidizer | Timing for Adding Si | Time of Holding Molten Steel | Bainite Area Fraction (%) | Hot Workability | Yield Strength | Fatigue Strength | Machinability | Fracture Splittability |
|---|---|---|---|---|---|---|---|---|---|---|---|---|---|
| 31 | 0.77 | 1.00 | A | A | A | A | A | 8 | C | A | C | A | A |
| 32 | 0.92 | 0.80 | A | A | A | A | A | 27 | B | A | B | A | A |
| 33 | 0.90 | 0.60 | A | A | A | A | A | 24 | A | A | A | A | A |
| 34 | 0.91 | 0.07 | A | A | A | A | A | 25 | A | A | A | A | A |
| 35 | 0.93 | 0.06 | A | A | A | A | A | 26 | A | A | A | A | B |
| 36 | 0.75 | 0.05 | A | A | A | A | A | 18 | A | A | A | A | C |
| 37 | 0.87 | 0.06 | A | A | A | A | A | 22 | A | A | S | A | A |
| 38 | 0.88 | 1.00 | A | A | A | A | A | 20 | A | A | S | A | A |
| 39 | 0.94 | 0.60 | A | A | A | A | A | 18 | A | A | S | A | A |
| 40 | 0.83 | 0.12 | A | A | A | A | A | 22 | A | A | A | S | A |
| 41 | 0.88 | 0.40 | A | A | A | A | A | 19 | A | A | A | S | A |
| 42 | 0.94 | 0.54 | A | A | A | A | A | 26 | A | A | A | S | A |
| 43 | 0.78 | 0.69 | A | A | A | A | A | 16 | A | A | A | S | A |
| 44 | 0.80 | 0.61 | A | A | A | A | A | 0 | A | A | A | A | A |
| 45 | 0.94 | 0.06 | A | A | A | A | A | 23 | A | A | A | NA | A |
| 46 | 0.77 | 0.99 | A | A | A | A | A | 25 | A | A | NA | A | A |
| 47 | 0.80 | 0.41 | A | A | A | A | A | 26 | NA | A | A | A | A |
| 48 | 0.94 | 0.06 | A | A | A | A | A | 26 | A | A | NA | A | A |
| 49 | 0.83 | 1.21 | A | A | A | A | A | 28 | NA | A | NA | A | A |
| 50 | 0.77 | 0.03 | A | A | A | A | A | 7 | A | A | A | A | NA |
| 51 | 1.01 | 0.12 | A | A | A | A | A | 23 | A | A | A | NA | A |
| 52 | 0.59 | 0.89 | A | A | A | A | A | 5 | A | NA | A | A | A |
| 53 | 0.93 | 0.02 | B | A | A | A | A | 19 | A | A | A | A | NA |
| 54 | 0.95 | 0.01 | A | B | A | A | A | 28 | A | A | A | A | NA |
| 55 | 0.80 | 0.02 | A | A | A | B | A | 18 | A | A | A | A | NA |
| 56 | 0.92 | 1.32 | A | A | H | A | A | 26 | NA | A | NA | A | A |
| 57 | 0.88 | 0.03 | A | A | L | A | A | 17 | A | A | A | A | NA |
| 58 | 0.81 | 1.40 | A | A | A | A | H | 11 | NA | A | NA | A | A |
| 59 | 0.94 | 0.04 | A | A | A | A | L | 18 | A | A | A | A | NA |
| 60 | 0.72 | 0.02 | A | A | A | A | A | 5 | NA | A | NA | B | NA |
| 61 | 0.76 | 0.03 | A | A | A | A | A | 0 | NA | A | NA | C | NA |

For the molten steel of each test number, immediately after tapping of the molten steel, desulfurizing treatment was performed by adding an aluminum deoxidizer to the ladle. Contents of Al in the aluminum deoxidizer used for the molten steels of the test numbers are shown in Table 3 and Table 4. Specifically, in the column "ALUMINUM DEOXIDIZER" in Table 3 and Table 4, "A" indicates that a content of Al in the aluminum deoxidizer was 80% or more. In the column "ALUMINUM DEOXIDIZER" in Table 3 and Table 4, "B" indicates that a content of Al in the aluminum deoxidizer was less than 80%.

For the molten steel of Test Numbers 1 to 60, the aluminum deoxidizer was added during the vacuum degassing treatment after the desulfurization treatment. For the molten steel of Test Number 60, the aluminum deoxidizer was added also immediately after the vacuum degassing treatment. For the molten steel of Test Number 61, the aluminum deoxidizer was not added after the desulfurization treatment.

Here, proportions of the aluminum deoxidizer added in the vacuum degassing for the molten steels of the test numbers are shown in Table 3 and Table 4. Specifically, in the column "PROPORTION OF ADDED DEOXIDIZER" in Table 3 and Table 4, "A" indicates that the aluminum deoxidizer added in the vacuum degassing accounted for 50 to 70% of the whole added aluminum deoxidizer. In the column "PROPORTION OF ADDED DEOXIDIZER" in Table 3 and Table 4, "L" indicates that the aluminum deoxidizer added in the vacuum degassing accounted for less than 50% of the whole added aluminum deoxidizer. In the column "PROPORTION OF ADDED DEOXIDIZER" in Table 3 and Table 4, "H" indicates that the aluminum deoxidizer added in the vacuum degassing accounted for more than 70% of the whole added aluminum deoxidizer.

In addition, a time from adding the aluminum deoxidizer in the vacuum degassing to adding Si for the molten steels of the test numbers are shown. Specifically, in the column "TIMING FOR ADDING Si" in Table 3 and Table 4, "A" indicates that the time from adding the aluminum deoxidizer in the vacuum degassing to adding Si was not less than 10 minutes. In the column "TIMING FOR ADDING Si" in Table 3 and Table 4, "B" indicates that the time from adding the aluminum deoxidizer in the vacuum degassing to adding Si was less than 10 minutes.

For molten steels of Test Numbers 1 to 57, 60, and 61, their temperatures of the molten steels were adjusted such that times during which the temperatures of the molten steels were 1600° C. or more were 25 minutes from adding the aluminum deoxidizer immediately after the tapping of the molten steels until starting casting. In contrast, for a molten steel of Test Number 58, the temperature of the molten steel was adjusted such that a time during which the temperature of the molten steel was 1600° C. or more was 70 minutes from adding the aluminum deoxidizer immediately after the tapping of the molten steels until starting casting. In addition, for a molten steel of Test Number 59, the temperature of the molten steel was adjusted such that a time during which the temperature of the molten steel was 1600° C. or more was 5 minutes from adding the aluminum deoxidizer immediately after the tapping of the molten steels until starting casting.

For the molten steels of the test numbers, the times during which the temperatures of the molten steels were 1600° C.

or more from adding the aluminum deoxidizer after the tapping of the molten steels until starting casting are shown in Table 3 and Table 4. Specifically, in the column "TIME OF HOLDING MOLTEN STEEL" in Table 3 and Table 4, "A" indicates that a time during which a temperature of a molten steel was 1600° C. or more from adding the aluminum deoxidizer after the tapping of the molten steel until starting casting was 15 to 60 minutes. In the column "TIME OF HOLDING MOLTEN STEEL" in Table 3 and Table 4, "L" indicates that a time during which a temperature of a molten steel was 1600° C. or more from adding the aluminum deoxidizer after the tapping of the molten steel until starting casting was less than 15 minutes. In the column "TIME OF HOLDING MOLTEN STEEL" in Table 3 and Table 4, "H" indicates that a time during which a temperature of a molten steel was 1600° C. or more from adding the aluminum deoxidizer after the tapping of the molten steel until starting casting was more than 60 minutes.

Subsequently, for the molten steels of the test numbers, a cast piece (bloom) was produced by the continuous casting process by using a continuous casting machine. The bloom had a cross section of 300 mm×400 mm.

The produced cast piece was subjected to the hot rolling to produce a billet. The billet was heated at 1150° C. for 35 minutes and thereafter subjected to the finish rolling with a finish rolling mill, to produce a steel bar having a diameter of 40 mm.

[Producing Hot-Forged Mock Product]

The steel bar was cut in a direction perpendicular to its longitudinal direction, and a sample material having a diameter of 40 mm and a length of 100 mm was taken. The sample material was heated and held at 1250° C. for five minutes. Immediately after the heating, the specimen was subjected to hot pressing in an axis direction at 90%, formed into a disk shape, and produce a hot-forged mock product (called a hot-forged mock product). The formed hot-forged mock product was allowed to be cooled in the atmosphere. After the allowing cooling, the specimen was reheated and held at 600° C. for 30 minutes. All of the hot-forged mock product of each test number produced by the above method had showed an absorbed energy E (2 mmV) in the Charpy impact test defined in JIS Z 2242 (2005) of less than about 20 J/cm$^2$, and showed a fracture toughness value $K_Q$ defined in ASTM E399-06 of less than 40 MPa√m.

[Evaluation Test]

Using the sample materials and the hot-forged mock products of the test numbers, the following evaluation test was conducted.

[Measurement Test of Number Density of Coarse $Al_2O_3$-Based Inclusions]

A sample was taken from an R/2 portion of a sample material of each test number. From a surface of the sample corresponding to a cross section including an axis direction of a sample material (longitudinal cross-section), 30 specimens each having a measurement area that was 4 mm long×2.5 mm wide were taken. For the taken specimens, the number density of coarse $Al_2O_3$-based inclusions (/mm$^2$) was measured by the above method. Determined number densities of coarse $Al_2O_3$-based inclusions (/mm$^2$) are shown in Table 3 and Table 4.

[Evaluation of Hot Workability]

By the above method, 50 hot-forged mock products were produced for each test number. Surfaces of the produced hot-forged mock products were each visually checked for the presence of a crack. A case in which the number of cracks occurring was zero for the fifty hot-forged mock products was determined as an evaluation "A", a case in which the number was one was determined as an evaluation "B", a case in which the number was two to three was determined as an evaluation "C", and a case in which the number was four or more was determined as an evaluation "NA". In cases of the evaluations "A" to "C", it was determined that excellent hot workabilities were obtained, and in a case of the evaluation "NA", it was determined that an excellent hot workability was not obtained. Results of the evaluation are shown in Table 3 and Table 4.

[Microstructure Observation]

Using hot-forged mock products of the test numbers, a microstructure observation test was conducted. Specifically, in a longitudinal cross-section of the hot-forged mock product, a sample including an R/2 portion was taken and the area fraction (%) of bainite was determined by the above method. Determined area fractions (%) of bainite are shown in Table 3 and Table 4.

[Evaluation of Yield Strength]

From an R/2 portion of the hot-forged mock product of each test number, two JIS 14A specimens defined in JIS Z 2241 (2011) were taken. Using the taken specimens, a tension test was conducted in the atmosphere at a room temperature (25° C.), determining a yield strength (MPa) as an average over the two specimens.

A case in which the yield strength YS (MPa) was 1000 to 801 MPa was determined as an evaluation "A", a case in which the yield strength was 800 to 601 MPa was determined as an evaluation "B", and a case in which the yield strength was 600 to 401 MPa was determined as an evaluation "C". A case in which the yield strength was not more than 400 MPa was determined as an evaluation "NA". Results of the evaluation are shown in Table 3 and Table 4.

In cases of the evaluations "A" to "C", it was determined that high yield strengths were obtained. In a case of the evaluation "NA", it was determined that the yield strength was low.

[Evaluation of Fatigue Strength]

From an R/2 portion of a hot-forged mock product, a JIS 14A specimen defined in JIS Z 2241 (2011) was taken. Using the taken specimen, an alternating fatigue test with a sine wave having a phase 0 (MPa) was conducted in the atmosphere at a room temperature (25° C.). A maximum stress below which the specimen was not broken off even when the number of repetition reached $10^7$ was determined as the fatigue strength (MPa). The frequency used in the test was set at 15 Hz.

A case in which the fatigue strength was 500 to 451 MPa was determined as an evaluation "S", a case in which the fatigue strength was 450 to 401 MPa was determined as an evaluation "A", a case in which the fatigue strength was 400 to 351 MPa was determined as an evaluation "B", and a case in which the fatigue strength was 350 to 301 MPa was determined as an evaluation "C". A case in which the fatigue strength was not more than 300 MPa was determined as an evaluation "NA". Results of the evaluation are shown in Table 3 and Table 4.

In cases of the evaluations "S", and "A" to "C", it was determined that high fatigue strengths were obtained. In a case of the evaluation "NA", it was determined that the fatigue strength was low.

[Evaluation of Machinability]

For each test number, five hot-forged mock products were prepared. The prepared five hot-forged mock products were subjected to drilling at arbitrary locations, and when the drilling was performed for 50 holes in total, an amount of wear of a tool used in the drilling was measured. A diameter of a drill was set at 10 mm, and a rotational speed of a spindle of the drill was set at 1000 rev/min.

A case in which the amount of wear of the tool was 0 to 10 μm was determined as an evaluation "S", a case in which the amount of wear of the tool was 11 to 30 μm was determined as an evaluation "A", a case in which the amount of wear of the tool was 31 to 50 μm was determined as an evaluation "B", and a case in which the amount of wear of the tool was 51 μm to 70 μm was determined as an evaluation "C". A case in which the amount of wear of the tool was not less than 71 μm was determined as an evaluation "NA". In cases of the evaluations "S", and "A" to "C", it was determined that excellent machinabilities were obtained. In a case of the evaluation "NA", it was determined that excellent machinability was not obtained. Results of the evaluation are shown in Table 3 and Table 4.

[Evaluation of Fracture Splittability]

Figure 2A:
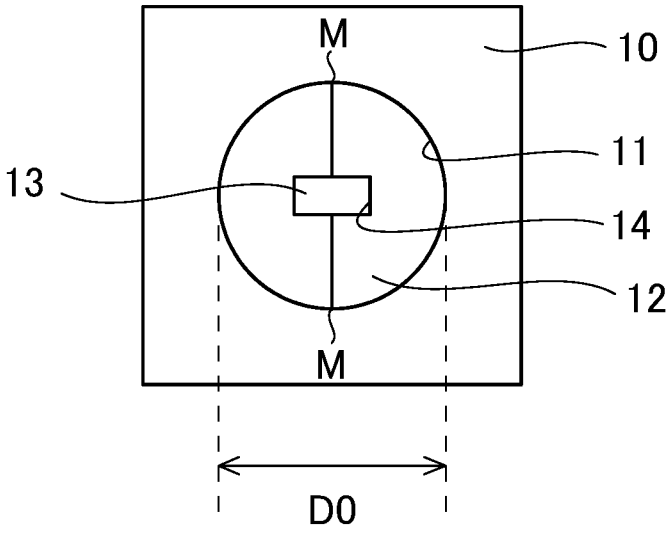
FIG. 2A is a plan view of a specimen used in an evaluation test for fracture splittability in Examples.

From the hot-forged mock products of the test numbers, a specimen 10 simulating a large end portion of a conrod illustrated in FIG. 2A was produced by machining. The specimen 10 had a length of 80 mm for one side and a thickness of 10 mm. At the center of the specimen 10, a hole (through hole) 11 was formed. The hole 11 had a diameter of 60 mm and had a center coaxial with the center of the specimen 10. As illustrated in FIG. 2A, on a circumference of the hole 11, notches M in a V shape were machined at two locations corresponding to end points of a diameter. The notches M each had a depth of 1 mm and a front edge with R of 0.1 mm, and an opening angle of 60°.

Figure 2B:
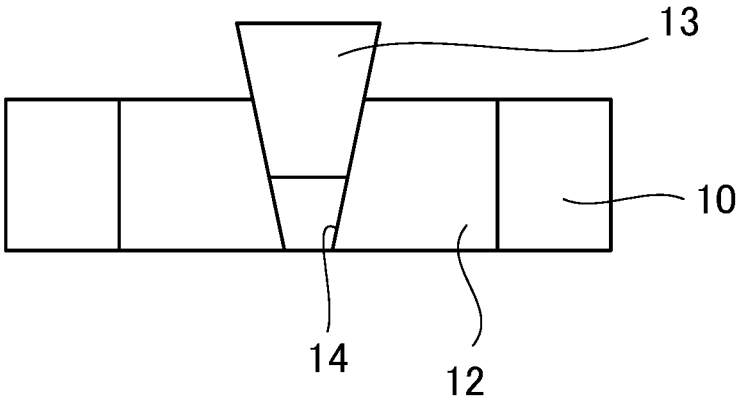
FIG. 2B is a cross-sectional view of the specimen illustrated in FIG. 2A.

A jig 12 was fitted into the hole 11. The jig 12 includes a pair of semicircle-plate-shaped members, which forms a disk having a diameter equivalent to the inner diameter of the hole 11. At the center of the jig 12, a hole 14 into which a wedge 13 was to be driven was formed (see FIG. 2B).

Figure 2C:
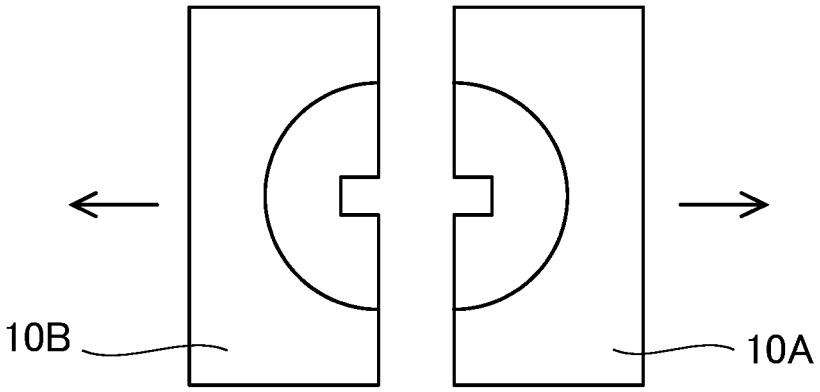
FIG. 2C is a plan view of the specimen, illustrating the specimen of FIG. 2A broken off to be separated.

After fitting the jig 12 into the hole 11, the wedge 13 was driven to break off and separate the specimen 10 into two members 10A and 10B at a room temperature (25° C.) (see FIG. 2C).

Figure 2D:
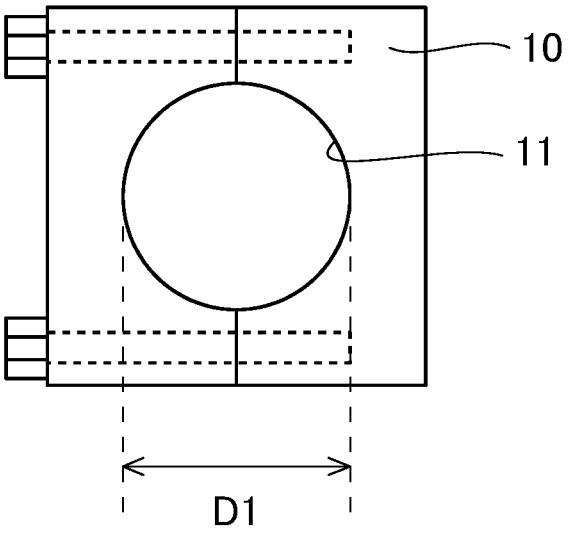
FIG. 2D is a plan view of the specimen, illustrating the specimen of FIG. 2C fastened to each other with bolts.

In each of the members 10A and 10B, bolt holes were machined in the vicinities of its both lateral sides, and the members 10A and 10B were fastened to each other with bolts illustrated FIG. 2D. A diameter D0 (see FIG. 2A) of the hole 11 of the specimen 10 before being broken off to be separated and a diameter D1 (see FIG. 2D) of the hole 11 of the specimen 10 after being broken off to be separated and fastened with the bolts were measured, and the difference between the diameters was defined as an inner diameter deformation amount ΔD(=D1−D0, in μm).

A case in which the inner diameter deformation amount ΔD was 0 to 30 μm was determined as an evaluation "A", a case in which the inner diameter deformation amount ΔD was 31 to 50 μm was determined as an evaluation "B", and a case in which the inner diameter deformation amount ΔD was 51 to 80 was determined as an evaluation "C". In addition, a case in which the inner diameter deformation amount ΔD was 81 μm or more was determined as an evaluation "NA". In cases of the evaluations "A" to "C", it was determined that excellent fracture splittabilities were obtained. In a case of the evaluation "NA", it was determined that an excellent fracture splittability was not obtained.

[Results of Evaluation]

Referring to Table 1 to Table 4, as to the test numbers 1 to 44, their chemical compositions were appropriate, and their fn1 satisfied Formula (1). In addition, their ladles, aluminum deoxidizers, proportions of added deoxidizer, timings for adding Si, and times of holding molten steel were also proper. Therefore, their number densities of coarse $Al_2O_3$-based inclusions in their steels fell within a range of 0.05 to 1.00/mm$^2$. As a result, their sample materials showed excellent hot workabilities. In addition, their hot-forged products showed high yield strengths, high fatigue strengths, and excellent machinabilities. In addition, although having area fractions of bainite in their microstructures of 0 to 30%, their hot-forged products showed excellent fracture splittabilities.

In contrast, in Test Number 45, its content of V was excessively high. As a result, its hot-forged product did not show an excellent machinability.

In Test Number 46, its content of V was excessively low. As a result, its hot-forged product did not show a high fatigue strength.

In Test Number 47, its content of Ti was excessively high. As a result, its sample material did not show an excellent hot workability.

In Test Number 48, its content of Ti was excessively low. As a result, its hot-forged product did not show a high fatigue strength.

In Test Number 49, its content of Al was excessively high. Accordingly, its number density of coarse $Al_2O_3$-based inclusions was excessively high. As a result, its sample material did not show an excellent hot workability. In addition, its hot-forged product did not show a high fatigue strength.

In Test Number 50, its content of Al was excessively low. Accordingly, its number density of coarse $Al_2O_3$-based inclusions was excessively low. As a result, its hot-forged product did not show an excellent fracture splittability.

In Test Number 51, its fn1 was excessively high. As a result, its hot-forged product did not show an excellent machinability.

In Test Number 52, its fn1 was excessively low. As a result, its hot-forged product did not show a high yield strength.

In Test Number 53, the ladle exclusively for aluminum deoxidation was not used as its ladle. Accordingly, its number density of coarse $Al_2O_3$-based inclusions was excessively low. As a result, its hot-forged product did not show an excellent fracture splittability.

In Test Number 54, its content of Al in the aluminum deoxidizer was excessively low. Accordingly, its number density of coarse $Al_2O_3$-based inclusions was excessively low. As a result, its hot-forged product did not show an excellent fracture splittability.

In Test Number 55, its time from adding the aluminum deoxidizer in the vacuum degassing to adding Si was excessively short. Accordingly, its number density of coarse $Al_2O_3$-based inclusions was excessively low. As a result, its hot-forged product did not show an excellent fracture splittability.

In Test Number 56, its proportion of the aluminum deoxidizer added in the vacuum degassing was excessively high. Accordingly, its number density of coarse $Al_2O_3$-based inclusions was excessively high. As a result, its sample material did not show an excellent hot workability. In addition, its hot-forged product did not show a high fatigue strength.

In Test Number 57, its proportion of the aluminum deoxidizer added in the vacuum degassing was excessively low. Accordingly, its number density of coarse $Al_2O_3$-based inclusions was excessively low. As a result, its hot-forged product did not show an excellent fracture splittability.

In Test Number 58, the time during which the temperature of the molten steel was 1600° C. or more from adding the aluminum deoxidizer after the tapping of the molten steel until starting casting was excessively long. Accordingly, its number density of coarse $Al_2O_3$-based inclusions was excessively high. As a result, its sample material did not show an excellent hot workability. In addition, its hot-forged product did not show a high fatigue strength.

In Test Number 59, the time during which the temperature of the molten steel was 1600° C. or more from adding the aluminum deoxidizer after the tapping of the molten steel until starting casting was excessively short. Accordingly, its number density of coarse $Al_2O_3$-based inclusions was excessively low. As a result, its hot-forged product did not show an excellent fracture splittability.

The chemical composition of the test number 60 was equivalent to that of Example 11 of Patent Literature 1. As to the test number 60, its content of C and its content of Mn were excessively low. In Test Number 60, in addition, its content of N was excessively high. In Test Number 60, in addition, its number density of coarse $Al_2O_3$-based inclusions was excessively low. As a result, its sample material did not show an excellent hot workability. In addition, as a result, its hot-forged product did not show a high fatigue strength. In addition, its hot-forged product did not show an excellent fracture splittability.

The chemical composition of the test number 61 was equivalent to that of Example 1 of Patent Literature 4. In Test Number 61, its content of C was excessively low. In Test Number 61, in addition, its content of Ti and its content of Al were excessively low. In Test Number 61, in addition, its number density of coarse $Al_2O_3$-based inclusions was excessively low. As a result, its sample material did not show an excellent hot workability. In addition, its hot-forged product did not show a high fatigue strength. In addition, its hot-forged product did not show an excellent fracture splittability.

The embodiment according to the present invention has been described above. However, the aforementioned embodiment is merely an example for practicing the present invention. Therefore, the present invention is not limited to the aforementioned embodiment, and the aforementioned embodiment can be modified and implemented as appropriate without departing from the scope of the present invention.

The invention claimed is:

1. A non-heat treated steel bar comprising a chemical composition consisting of, in mass percent:

C: 0.39 to 0.55%;
Si: 0.10 to 1.00%;
Mn: 0.50 to 1.50%;
P: 0.010 to 0.100%;
S: 0.040 to 0.130%;
Cr: 0.05 to 0.50%;
V: 0.05 to 0.40%;
Ti: 0.10% to 0.25%;
Al: 0.003 to 0.100%;
N: 0.020% or less;
Cu: 0 to 0.40%;
Ni: 0 to less than 0.20%;
Mo: 0 to 0.10%;
Pb: 0 to 0.30%;
Te: 0 to 0.3000%;
Ca: 0 to 0.0100%; and
Bi: 0 to 0.3000%, with the balance being Fe and impurities including oxygen, the chemical composition satisfying Formula (1), wherein in the steel bar, a number density of $Al_2O_3$-based inclusions in each of which $Al_2O_3$is contained at 70.0% or more in mass percent and $\sqrt{AREA}$ is not less than 3 μm is 0.05 to 1.00/mm$^2$:

$$0.60 \leq C+0.2Mn+0.25Cr+0.75V+0.81Mo \leq 1.00 \quad (1)$$

where symbols of elements in Formula (1) are to be substituted by contents of corresponding elements (in mass percent).

2. The non-heat treated steel bar according to claim 1, wherein the chemical composition contains one or more types of element selected from the group consisting of:

Cu: 0.01 to 0.40%;
Ni: 0.01 to less than 0.20%; and
Mo: 0.01 to 0.10%.

3. The non-heat treated steel bar according to claim 2, wherein the chemical composition contains one or more types of element selected from the group consisting of:

Pb: 0.05 to 0.30%;
Te: 0.0003 to 0.3000%;
Ca: 0.0003 to 0.0100%; and
Bi: 0.0003 to 0.3000%.

4. The non-heat treated steel bar according to claim 1, wherein the chemical composition contains one or more types of element selected from the group consisting of:

Pb: 0.05 to 0.30%;
Te: 0.0003 to 0.3000%;
Ca: 0.0003 to 0.0100%; and
Bi: 0.0003 to 0.3000%.

* * * * *